US008523380B1

(12) United States Patent
Grant et al.

(10) Patent No.: US 8,523,380 B1
(45) Date of Patent: Sep. 3, 2013

(54) ILLUMINATED SCREEN OR WINDOW ATTACHMENT

(76) Inventors: Barbara C. Grant, Indian Wells, CA (US); Sarah A. Jenko, Indian Wells, CA (US)

( * ) Notice: Subject to any disclaimer, the term of this patent is extended or adjusted under 35 U.S.C. 154(b) by 600 days.

(21) Appl. No.: 12/837,970

(22) Filed: Jul. 16, 2010

(51) Int. Cl.
*F21V 21/00* (2006.01)

(52) U.S. Cl.
USPC ..... 362/190; 362/184; 362/191

(58) Field of Classification Search
None
See application file for complete search history.

(56) References Cited

U.S. PATENT DOCUMENTS

| | | | | |
|---|---|---|---|---|
| 5,680,893 | A | 10/1997 | Neer | |
| 5,730,196 | A | 3/1998 | Frament | |
| 6,017,608 | A | 1/2000 | Braun et al. | |
| D426,738 | S | 6/2000 | Goodwin | |
| 6,557,284 | B2 * | 5/2003 | Nolan | 40/574 |
| 6,776,505 | B1 * | 8/2004 | DeWitt | 362/644 |
| 6,794,011 | B2 | 9/2004 | Allard | |
| D506,701 | S | 6/2005 | Adams | |
| 7,065,910 | B2 * | 6/2006 | Woodruff | 40/544 |
| 7,398,816 | B2 | 7/2008 | Sala | |
| 2003/0210555 | A1 * | 11/2003 | Cicero et al. | 362/555 |
| 2008/0060237 | A1 * | 3/2008 | Chiang et al. | 40/564 |
| 2009/0147519 | A1 * | 6/2009 | Klipstein et al. | 362/249.02 |
| 2010/0180476 | A1 * | 7/2010 | Welch et al. | 40/201 |

* cited by examiner

*Primary Examiner* — Ashok Patel

(57) ABSTRACT

An illuminated attachment is provided for enhancing safety by increasing visibility of a screen or window to prevent accidental contact with the screen or window. The attachment includes a housing, a power source positioned in the housing, a frame coupled to the housing, and a plurality of lights coupled to the frame. The plurality of lights is operationally coupled to the power source. A switch assembly is operationally coupled between the power source and the plurality of lights for selectively illuminating the plurality of lights. An attachment member such as a first magnet is coupled to the housing. Thus, the housing is designed for coupling to a planar material such as screen or window.

20 Claims, 4 Drawing Sheets

ILLUMINATED SCREEN OR WINDOW ATTACHMENT

BACKGROUND OF THE DISCLOSURE

Field of the Disclosure

The disclosure relates to screen and window attachments and more particularly pertains to a new decorative attachment for enhancing visibility of a screen or window to prevent accidental contact with the screen or window.

SUMMARY OF THE DISCLOSURE

An embodiment of the disclosure meets the needs presented above by generally comprising a housing, a power source positioned in the housing, a frame coupled to the housing, and a plurality of lights coupled to the frame. The lights, which may primarily include light emitting diode type lights (LEDs), are operationally coupled to the power source. A switch assembly is operationally coupled between the power source and the plurality of lights for selectively illuminating the plurality of lights. A first magnet is coupled to the housing. Thus, the housing is designed for coupling to a planar material such as metal screen or window.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
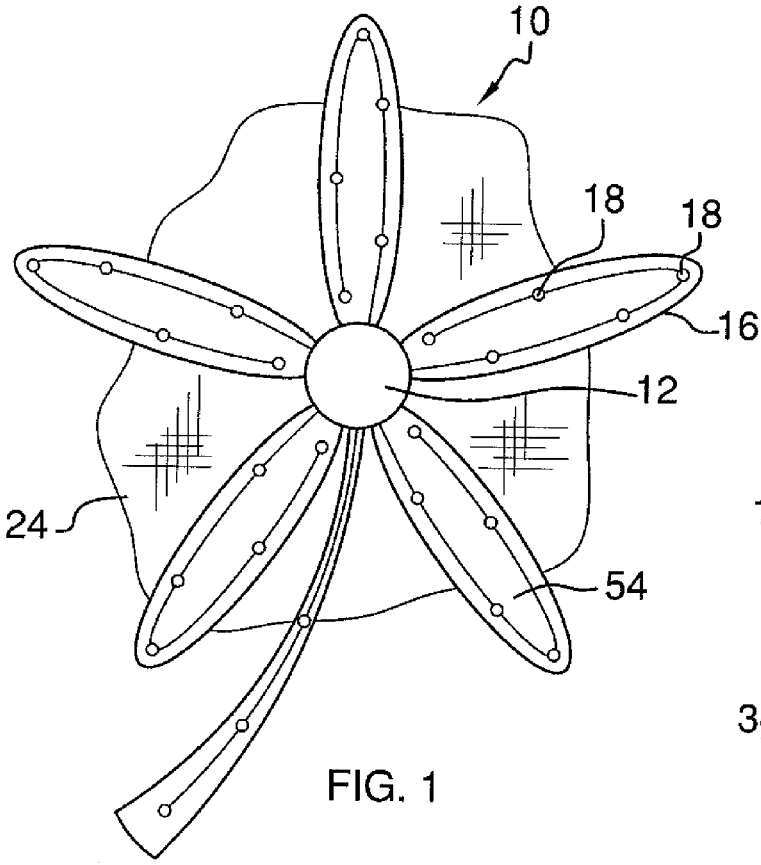
FIG. 1 is a front view of an illuminated screen or window attachment according to an embodiment of the disclosure.
Figure 2:
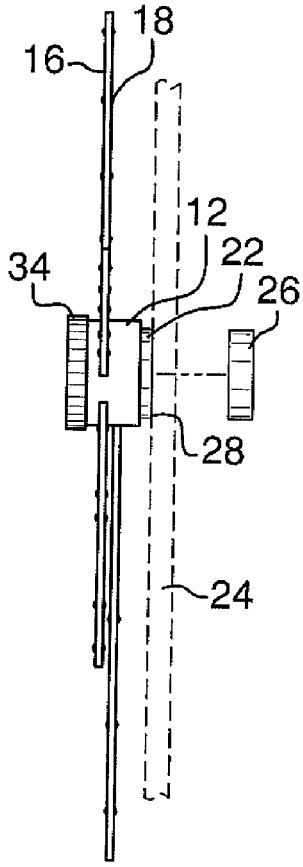
FIG. 2 is a side view of an embodiment of the disclosure.
Figure 3:
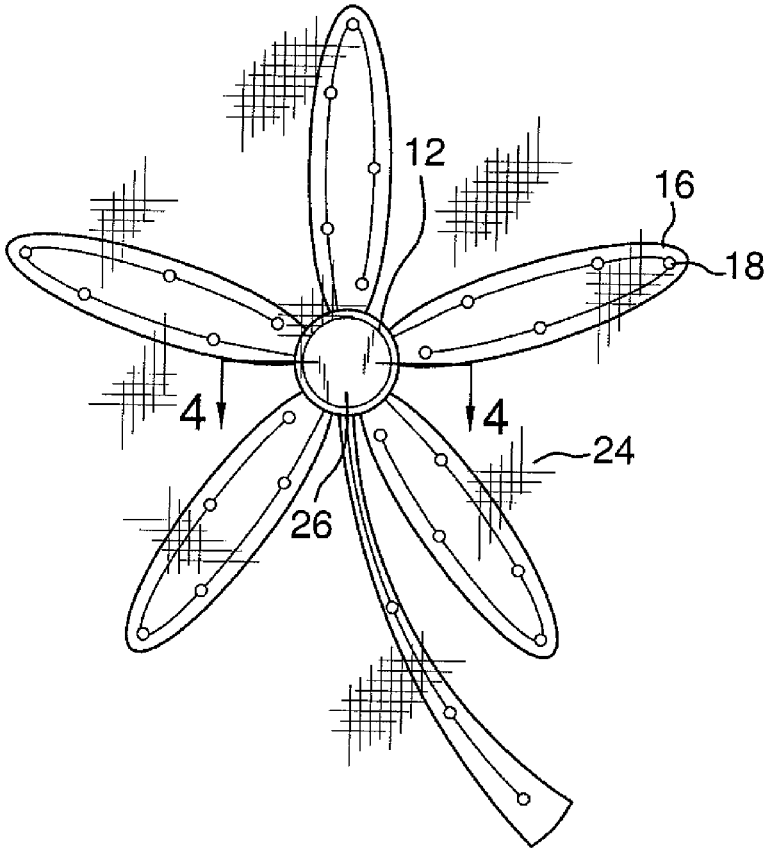
FIG. 3 is a back view of an embodiment of the disclosure.

With reference now to the drawings, and in particular to FIGS. 1 through 6 thereof, a new illuminated attachment embodying the principles and concepts of an embodiment of the disclosure and generally designated by the reference numeral 10 will be described.

As best illustrated in FIGS. 1 through 6, the illuminated screen or window attachment 10 generally comprises a housing 12, a power source 14 positioned in the housing 12, a frame 16 coupled to the housing 12, and a plurality of lights

18 coupled to the frame 12. The plurality of lights 18 is operationally coupled to the power source 14. The power source 14 is preferably a self-contained battery. A switch assembly 20 is operationally coupled between the power source 14 and the plurality of lights 18 for selectively illuminating the plurality of lights 18. An attachment member 28 such as hook and loop fastener or a first magnet 22 is coupled to the housing 12. Thus, the housing 12 is designed for coupling to a planar member 24 such as a metal screen, a fabric screen or a window pane.

A second magnet 26, complimentary to the first magnet 22, may be provided. Thus, the housing 12 is designed for being coupled to a planar member 24 positioned between the first magnet 22 and the second magnet 26. This attachment means also allows the housing 12 to be selectively coupled to non-metallic materials such as fabric mesh, fabric screen and glass window panes.

The housing 12 may have an interior 30 and an opening 32. A cap member 34 is selectively couplable to the housing 12 to cover the opening 32. A first contact member 36 is positioned in the interior 30 of the housing 12. A second contact member 38 is also positioned in the interior 30 of the housing 12 adjacent to the opening 32 so that the cap member 34 urges the second contact member 38 into contact with the power source 14 when the cap member 34 is coupled to the housing 12.

A protrusion 40 is positioned between the cap member 34 and the second contact member 38. The protrusion 40 may extend from the cap member 34 for facilitating contact between the cap member 34 and the second contact member 38. The housing 12 may have housing threading 42 and the cap member 34 may have cap threading 44 complimentary to the housing threading 42 to allow the cap member 34 to be threadably couplable to the housing 12.

Figure 4:
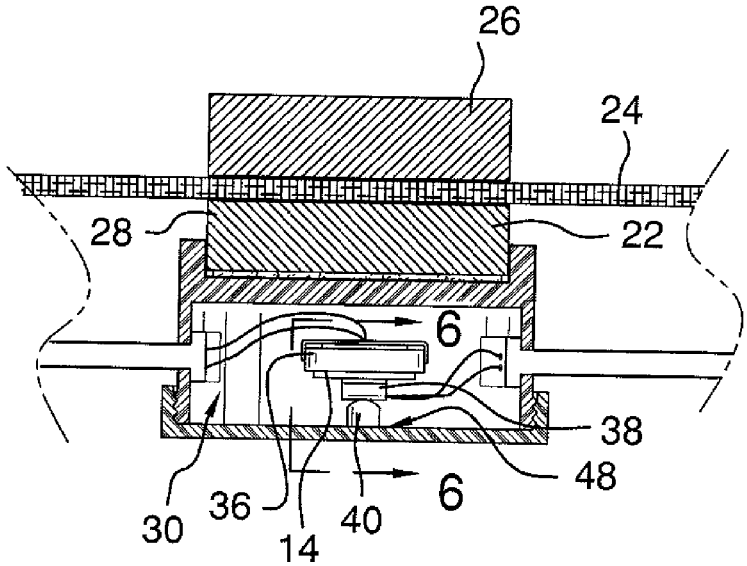
FIG. 4 is a cross-sectional view of an embodiment of the disclosure taken along line 4-4 of FIG. 3.
Figure 5:
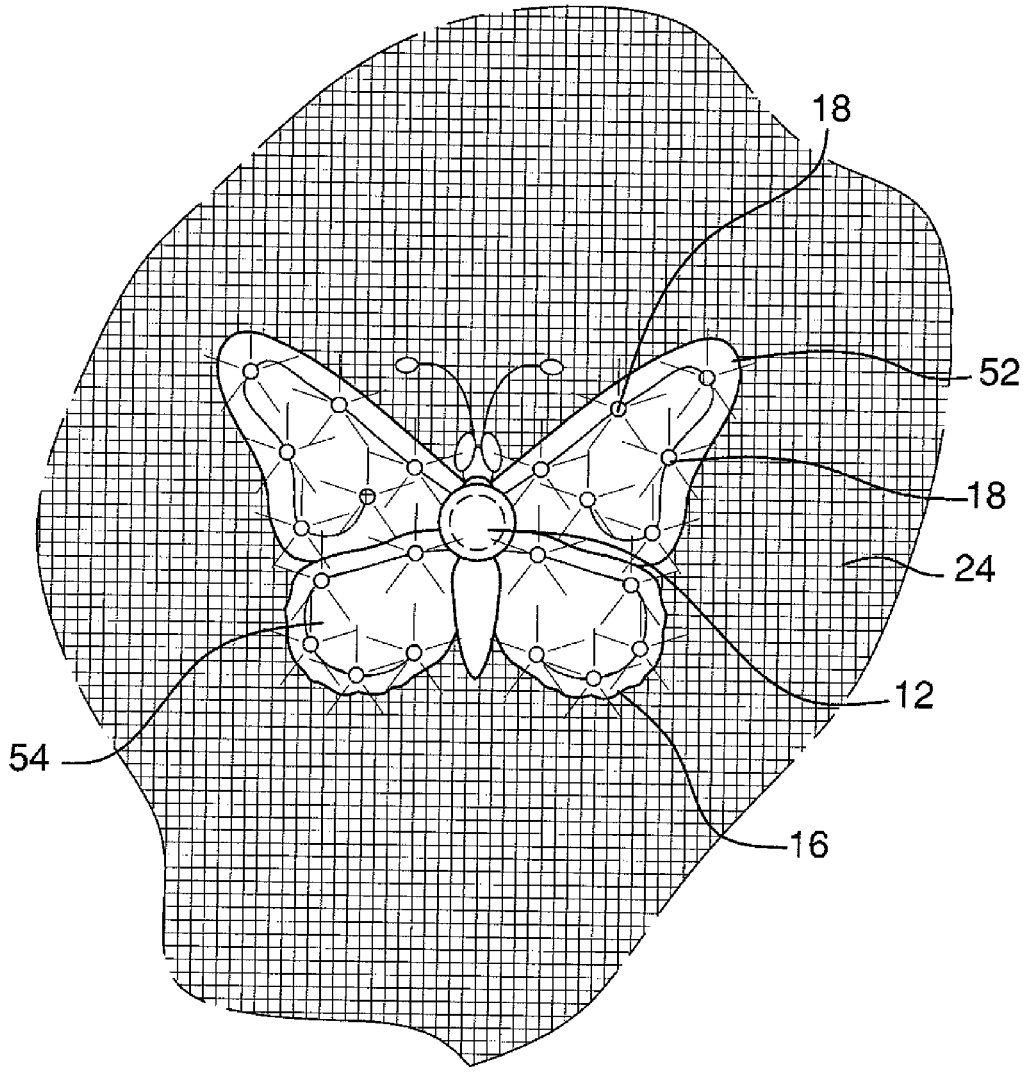
FIG. 5 is a front view of an embodiment of the disclosure in use.
Figure 6:
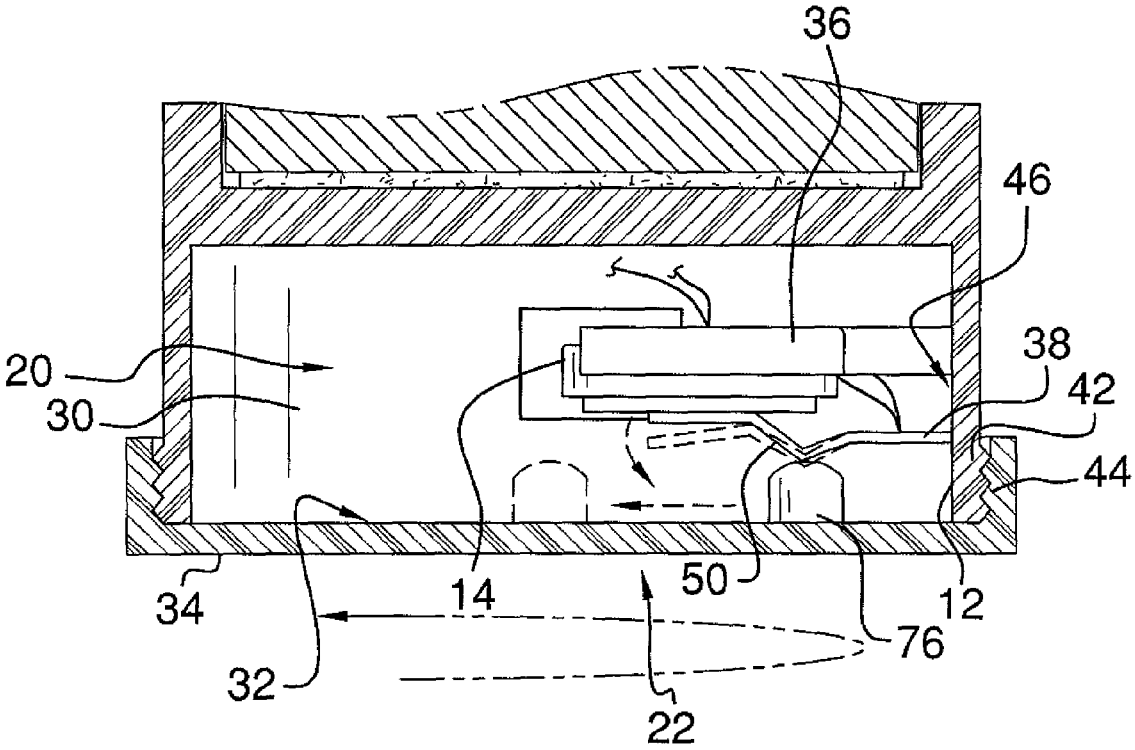
FIG. 6 is a cross-sectional view of an alternate embodiment of the power source compartment of the disclosure.

The protrusion 40 may be centrally positioned with respect to the cap member 34 as shown in FIG. 4. Alternatively, as shown in FIG. 6, the second contact member 38 may extend into the housing 12 from a side wall 46 of the housing 12. The protrusion 76 may be offset from a center 48 of the cap member 34 such that the protrusion 76 is selectively positionable in contact with the second contact member 38 to bias the second contact member 38 into contact with the power source 14. The second contact member 38 may include a bent medial portion 50 alignable with the protrusion 76 to facilitate contact between the second contact member 38 and the power source 14 when the cap member 34 is rotated to bring the protrusion 76 into contact with the crooked medial portion 50.

The frame 16 may be comprised of a reflective material for enhancing visibility of the frame 16. Moreover, the frame 16 may form a decorative design 52 and decorative material 54 may be coupled to the frame 16. The plurality of lights 18 is then couplable to the material 54. The lights 18 may be light emitting diodes (LEDs) and can be provided in a multitude of colors.

In use, the housing 12 is attached to a screen or window by the attachment member 28 or magnetically using the first magnet 22 and the second magnet 26 when necessary. The frame 16 provides visibility during the day or in lighted conditions. The frame 16 forms a decorative appearance and may be structured in a variety of shapes including but not limited to hearts, animals, birds, holiday or seasonal symbols such as a Christmas tree or pumpkin, and the like. At night or in otherwise darkened conditions, the cap member 34 may be rotated to complete a circuit and illuminate the plurality of lights 18. Thus, the attachment 10 is an improvement over prior art because the attachment 10 illuminates to enhance visibility and increase safety by preventing unintended contact with a window or screen.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. An illuminated attachment for a planar member comprising:

a housing, said housing having an interior and an opening;

a power source positioned in said housing;

a frame coupled to said housing;

a plurality of lights coupled to said frame, said plurality of lights being operationally coupled to said power source;

a switch assembly operationally coupled between said power source and said plurality of lights for selectively illuminating said plurality of lights; and an attachment member coupled to said housing whereby said housing is adapted for coupling to the planar member;

a cap member selectively couplable to said housing to cover said opening;

a first contact member being positioned in said interior of said housing; and a second contact member being positioned in said interior of said housing adjacent to said opening such that said cap member urges said second contact member into contact with said power source when said cap member is coupled to said housing.

2. The illuminated attachment of claim 1, wherein said frame forms a decorative design.

3. The illuminated attachment of claim 2, further including material coupled to said frame, said plurality of lights being coupled to said material.

4. The illuminated attachment of claim 1, further including a protrusion positioned between said cap member and said second contact member for facilitating contact between said cap member and said second contact member.

5. The illuminated attachment of claim 4, further comprising:

said housing having housing threading; and said cap member having cap threading complimentary to said housing threading such that said cap member is threadably couplable to said housing.

6. The illuminated attachment of claim 4, wherein said protrusion is centrally positioned with respect to said cap member.

7. The illuminated attachment of claim 5, further comprising:

said second contact member extending into said housing from a side wall of said housing; and said protrusion being offset from a center of said cap member such that said protrusion is selectively positionable in contact with said second contact member to bias said second contact member into contact with said power source.

8. The illuminated attachment of claim 7, wherein said second contact member includes a crooked medial portion alignable with said protrusion to facilitate contact between said second contact member and said power source when said cap member is rotated to bring said protrusion into contact with said crooked medial portion.

9. The illuminated attachment of claim 1, wherein said frame is reflective for enhancing visibility of said frame.

10. An illuminated attachment for a planar member comprising:

a housing;

a power source positioned in said housing;

a frame coupled to said housing;

a plurality of lights coupled to said frame, said plurality of lights being operationally coupled to said power source;

a switch assembly operationally coupled between said power source and said plurality of lights for selectively illuminating said plurality of lights;

an attachment member coupled to said housing whereby said housing is adapted for coupling to the planar member;

said attachment member being a first magnet; and a second magnet, said second magnet being complimentary to said first magnet whereby said housing is adapted for being coupled to the planar member by positioning the planar member between said first magnet and said second magnet.

11. The illuminated attachment of claim 10, further comprising:

said housing having an interior and an opening;

a cap member selectively couplable to said housing to cover said opening;

a first contact member being positioned in said interior of said housing; and a second contact member being positioned in said interior of said housing adjacent to said opening such that said cap member urges said second contact member into contact with said power source when said cap member is coupled to said housing.

12. The illuminated attachment of claim 11, further including a protrusion positioned between said cap member and said second contact member for facilitating contact between said cap member and said second contact member.

13. The illuminated attachment of claim 12, further comprising:

said housing having housing threading; and said cap member having cap threading complimentary to said housing threading such that said cap member is threadably couplable to said housing.

14. The illuminated attachment of claim 13, further comprising:

said second contact member extending into said housing from a side wall of said housing; and said protrusion being offset from a center of said cap member such that said protrusion is selectively positionable in contact with said second contact member to bias said second contact member into contact with said power source.

15. The illuminated attachment of claim 14, wherein said second contact member includes a crooked medial portion alignable with said protrusion to facilitate contact between said second contact member and said power source when said cap member is rotated to bring said protrusion into contact with said crooked medial portion.

16. The illuminated attachment of claim 12, wherein said protrusion is centrally positioned with respect to said cap member.

17. The illuminated attachment of claim 10, wherein said frame is reflective for enhancing visibility of said frame.

18. An illuminated attachment for a planar member comprising:

a housing;

a power source positioned in said housing;

a frame coupled to said housing;

a plurality of lights coupled to said frame, said plurality of lights being operationally coupled to said power source;

a switch assembly operationally coupled between said power source and said plurality of lights for selectively illuminating said plurality of lights;

a first magnet coupled to said housing whereby said housing is adapted for coupling to the planar member;

a second magnet, said second magnet being complimentary to said first magnet whereby said housing is adapted for being coupled to the planar member by positioning the planar member between said first magnet and said second magnet;

said housing having an interior and an opening;

a cap member selectively couplable to said housing to cover said opening;

a first contact member being positioned in said interior of said housing;

a second contact member being positioned in said interior of said housing adjacent to said opening such that said cap member urges said second contact member into contact with said power source when said cap member is coupled to said housing;

a protrusion extending from said cap member for facilitating contact between said cap member and said second contact member;

said housing having housing threading;

said cap member having cap threading complimentary to said housing threading such that said cap member is threadably couplable to said housing;

wherein said frame is reflective for enhancing visibility of said frame;

wherein said frame forms a decorative design; and material coupled to said frame, said plurality of lights being coupled to said material.

19. The illuminated attachment of claim 18, wherein said protrusion is centrally positioned on said cap member.

20. The illuminated attachment of claim 18, further comprising:

said second contact member extending into said housing from a side wall of said housing;

said protrusion being offset from a center of said cap member such that said protrusion is selectively positionable in contact with said second contact member to bias said second contact member into contact with said power source; and wherein said second contact member includes a crooked medial portion alignable with said protrusion to facilitate contact between said second contact member and said power source when said cap member is rotated to bring said protrusion into contact with said crooked medial portion.

* * * * *